US008272881B2

(12) United States Patent
Miyazaki et al.

(10) Patent No.: US 8,272,881 B2
(45) Date of Patent: Sep. 25, 2012

(54) CONNECTOR HAVING A LOCK MECHANISM FOR KEEPING A SOCKET AND A HEADER COUPLED, AND METHOD FOR MANUFACTURING THE CONNECTOR

(75) Inventors: Yoji Miyazaki, Tsu (JP); Kenji Okura, Tsu (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/659,793

(22) Filed: Mar. 22, 2010

(65) Prior Publication Data

US 2010/0248520 A1 Sep. 30, 2010

(30) Foreign Application Priority Data

Mar. 24, 2009 (JP) ..... 2009-071199

(51) Int. Cl.
*H01R 12/00* (2006.01)

(52) U.S. Cl. ..... 439/74; 439/345

(58) Field of Classification Search ..... 439/74, 439/345, 353, 357, 358, 660
See application file for complete search history.

(56) References Cited

U.S. PATENT DOCUMENTS

| | | | | |
|---|---|---|---|---|
| 5,639,248 | A * | 6/1997 | Yagi | 439/74 |
| 6,844,089 | B2 * | 1/2005 | Richter et al. | 428/690 |
| 7,390,196 | B2 * | 6/2008 | Sasaki | 439/74 |
| 7,425,158 | B2 * | 9/2008 | Ookura | 439/660 |
| 7,484,969 | B2 * | 2/2009 | Shiu | 439/74 |
| 2004/0102065 | A1 | 5/2004 | Obikane et al. | |
| 2007/0020967 | A1 | 1/2007 | Midorikawa | |
| 2007/0281519 | A1 | 12/2007 | Shiroyama | |
| 2009/0029572 | A1 | 1/2009 | Midorikawa | |

FOREIGN PATENT DOCUMENTS

| | | |
|---|---|---|
| JP | 2004127572 | 4/2004 |
| JP | 2007035291 | 2/2007 |
| JP | 2007328961 | 12/2007 |
| JP | 2009032425 | 2/2009 |
| WO | WO 2005096453 A1 * | 10/2005 |

OTHER PUBLICATIONS

Japanese Office Action issued in Japanese application No. 2009-071199, dated Feb. 22, 2011, 6 pages.

* cited by examiner

*Primary Examiner* — Tulsidas C Patel
*Assistant Examiner* — Travis Chambers
(74) *Attorney, Agent, or Firm* — Bacon & Thomas, PLLC

(57) ABSTRACT

A connector includes a socket having a generally rectangular shape, the socket including socket contacts, lock mechanisms and retainer mechanisms; and a header having a generally rectangular shape, the header including header contacts and lock mechanisms and being couplable with the socket. The lock mechanisms of the socket and the header are respectively formed from the socket contacts and the header contacts, the lock mechanisms of the socket being formed by cutting away a portion of the socket contacts. The lock mechanisms of the header also serve as retainer mechanisms thereof. The lock mechanisms of the socket and the header are arranged substantially in the same row as the socket contacts and the header contacts and positioned near four corners of the socket and the header, respectively. The lock mechanisms of the socket and the header are configured to keep the socket and the header in a coupled state.

20 Claims, 12 Drawing Sheets

CONNECTOR HAVING A LOCK MECHANISM FOR KEEPING A SOCKET AND A HEADER COUPLED, AND METHOD FOR MANUFACTURING THE CONNECTOR

FIELD OF THE INVENTION

The present invention relates to a connector provided with lock mechanisms for keeping the coupling state of a socket and a header which are coupled together and electrically connected to each other.

BACKGROUND OF THE INVENTION

In portable devices that are undergoing rapid reduction in size, it is required to reduce the height of a connector and contacts (or signal terminals), which is called profile reduction. However, the profile reduction is accompanied by reduction in the coupling force of a socket and a header. For that reason, the portable devices vulnerable to shocks caused by dropping or the like need to have a configuration that makes it hard to separate a socket and a header. A connector provided with lock mechanisms for keeping the socket and the header in a coupled state is disclosed in Japanese Patent Application Publication No. 2003-234150.

In addition to the connector disclosed in Japanese Patent Application Publication No. 2003-234150, there is known a connector 40 as shown in FIG. 11, which includes a socket 41 having socket-side lock clasps (lock mechanisms) and a header 42 having header-side lock clasps (lock mechanisms) 48. The socket-side lock clasps 46 are arranged in an opposing relationship at the sides of a socket body 43 where socket contacts 45 do not exist. This holds true in case of the header-side lock clasps 48.

Since the header-side lock clasps 48 have no elasticity, the header 42 needs to be inserted into the socket 41 with an increased force when the former is coupled with the latter. Furthermore, since the socket-side lock clasps 46 and the header-side lock clasps 48 are respectively arranged in an opposing relationship at the sides of the socket 41 and the header 42 where socket contacts 45 and header contacts 27 do not exist, the socket 41 and the header 42 need to be pressed against each other in a well-balanced manner, while keeping them parallel in the coupling process thereof. In addition, it is sometimes the case that the planarity of contacts is destroyed in the manufacturing process of the connector 40 provided with a lock mechanism.

A process for manufacturing the header 42 shown in FIG. 11 will now be described in detail. Referring to FIG. 12, the manufacturing process of the header 42 is divided into stations A through D arranged sequentially. In station A, header contact workpieces 50 have an elongated shape and are provided with a plurality of header contacts 47 as a part thereof.

In station B, unnecessary header contacts 47 are cut away, leaving only the header contacts 27 that will form the header 42. In station C, the header contacts 47 left in station B are insert-molded with a header body 44. In station D, header-side lock clasps 48 are press-fitted to the header body 44, thereby manufacturing a header 42.

In station. D, it is often the case that a force is inadvertently applied to the header contacts 47 when the header-side lock clasps 48 are press-fitted to the header body 44. Inasmuch as the header contacts 47 are made of an easily bendable material, the planarity of the header contacts 47 may be destroyed by the force inadvertently applied thereto.

Moreover, there is a problem in that the manufacturing process involves an increased number of steps due to the complex structure of the header 42 (the connector provided with a lock mechanism). In addition, the number of parts gets greater because of the need to employ the header-side lock clasps 48 (namely, the parts forming the lock mechanism).

SUMMARY OF THE INVENTION

In view of the above, the present invention provides a connector provided with lock mechanisms for keeping a socket and a header in a coupled state, which is small in part number, structurally simple and easy to assemble. The present invention also provides a method for manufacturing the connector.

In accordance with an aspect of the present invention, there is provided a connector including: a socket having a generally rectangular shape, the socket including socket contacts, lock mechanisms and retainer mechanisms; and a header having a generally rectangular shape, the header including header contacts and lock mechanisms and being couplable with the socket, wherein the lock mechanisms of the socket and the header are respectively formed from the socket contacts and the header contacts, the lock mechanisms of the socket being formed by cutting away a portion of the socket contacts, the lock mechanisms of the header also serving as retainer mechanisms thereof, the lock mechanisms of the socket being arranged substantially in the same row as the socket contacts and positioned near four corners of the socket, the lock mechanisms of the header being arranged substantially in the same row as the header contacts and positioned near four corners of the header, the lock mechanisms of the socket and the header being configured to keep the socket and the header in a coupled state.

With such configuration, the lock mechanisms of the socket and the header are formed from the socket contacts and the header contacts. Thus, the coupling force of the lock mechanisms is added to the coupling force of the socket contacts and the header contacts, which results in an increased coupling force. This provides a configuration in which the socket and the header are hard to be separated from each other. Moreover, the lock mechanisms of the socket are formed by cutting away a portion of the socket contacts. Therefore, the lock mechanisms of the socket have increased elasticity, which assists in forming easy-to-insert lock mechanisms. In addition, the lock mechanisms of the socket and the header are positioned near the corners of the socket and the header. This helps provide well-balanced stable lock mechanisms.

The lock mechanisms of the header serve as the retainer mechanisms thereof. This makes it possible to omit the retainer mechanisms required in the prior art. The lock mechanisms of the socket and the header are arranged substantially in the same row as the socket contacts and the header contacts. Thus, the socket has a simple structure as compared with the complex structure of the conventional socket. This helps increase the productivity of the connector.

Preferably, the lock mechanisms of the socket and the header are insert-molded with the socket and the header, respectively.

With such configuration, it is possible to eliminate the need to employ a step of press-fitting lock mechanisms, which has been conventionally performed after production of the connector. Therefore, there occurs no variation in the planarity of the socket contacts, which has been problematic in the step of press-fitting lock mechanisms.

In accordance with another aspect of the present invention, there is provided a method for manufacturing a connector, including: providing a socket body; insert-molding socket retainer mechanisms, socket contacts and socket lock mechanisms with the socket body to form a socket; providing a header body; and insert-molding header contacts and header lock mechanisms with the header body to form a header.

With such configuration, the component parts of the socket and the header are insert-molded to form the socket and the header, respectively. This helps simplify the manufacturing process of the connector. Accordingly, it is possible to enhance the assembling accuracy and product precision of the connector.

According to the present invention, it is possible to provide a connector provided with lock mechanisms for keeping a socket and a header in a coupled state, which is small in part number, structurally simple and easy to assemble. The present invention is also capable of providing a method for manufacturing the connector.

DETAILED DESCRIPTION OF THE PREFERRED EMBODIMENTS

The configuration of a connector in accordance with one embodiment of the present invention, which is provided with lock mechanisms for keeping a socket and a header in a coupled state, will be first described with reference to the accompanying drawings. It should be understood that the following description is not intended to limit the scope of the present invention but to increase the understanding of the embodiment of the present invention.

Figure 1:
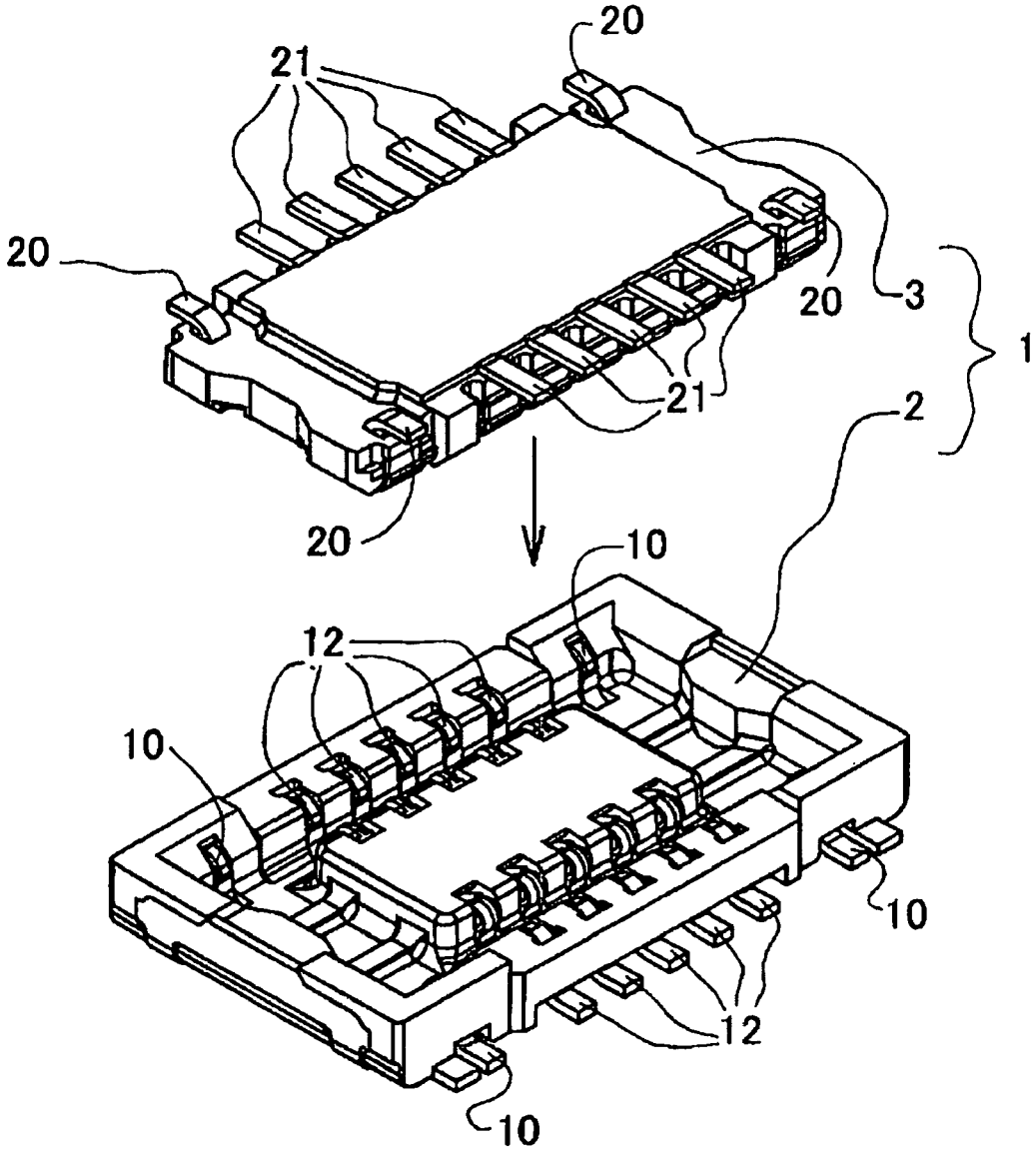
FIG. 1 is an exploded perspective view showing a connector in accordance with one embodiment of the present invention, which is provided with lock mechanisms for keeping a socket and a header in a coupled state

Referring to FIG. 1, a connector 1 in accordance with the embodiment of the present invention includes a socket 2 and a header 3. Description will be first made on the structures of the socket 2 and the header 3 and then the coupling method thereof.

Figure 2A:
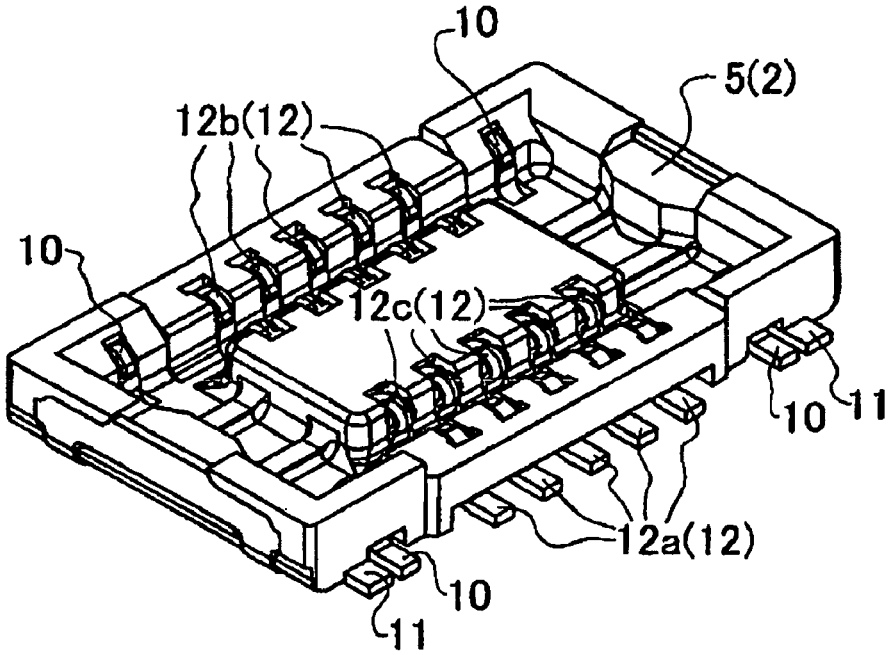
FIGS. 2A and 2B are perspective views showing the socket in accordance with the embodiment of the present invention.
Figure 2B:
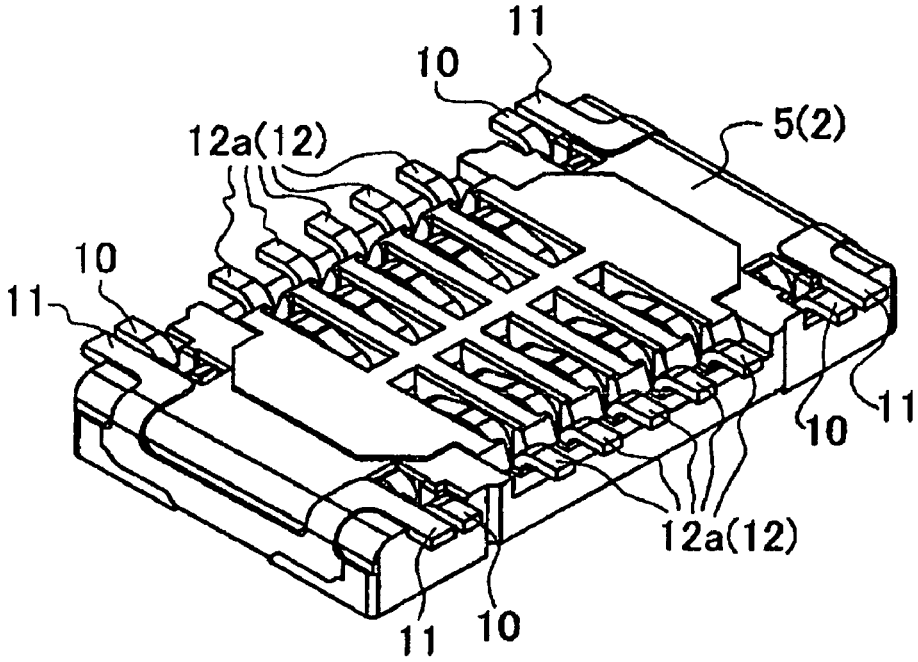
Figure 3A:
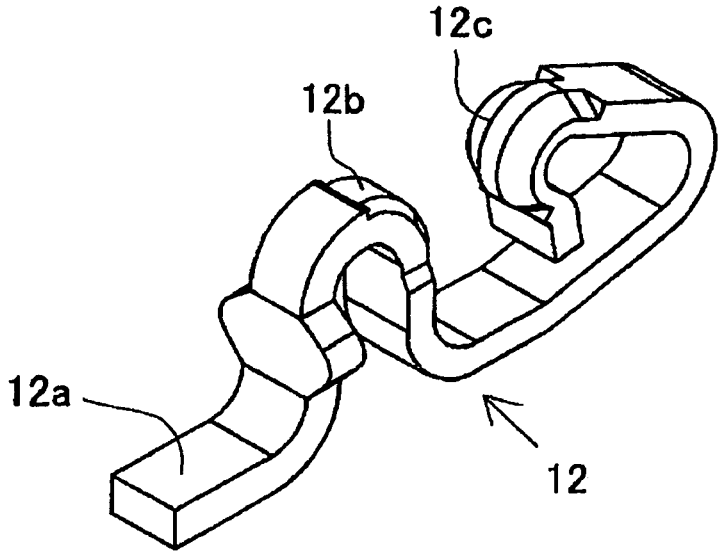
FIG. 3A is a perspective view showing a socket contact in accordance with the embodiment of the present invention.
Figure 3B:
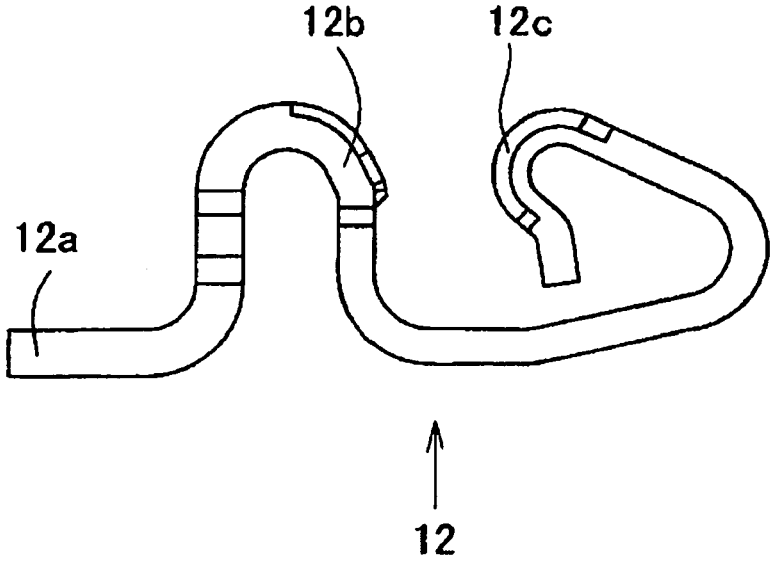
FIG. 3B is a side view thereof.

The socket 2 will be described first. FIG. 2A shows the front side of the socket 2, and FIG. 2B shows the rear side thereof. The socket 2 includes a socket body 5, socket-side lock clasps (lock mechanisms) 10, retainer portions (retainer mechanisms) 11 and socket contacts 12. As shown in FIGS. 2A and 2B, each of the socket contacts 12 is formed of a lead pin 12*a*, an outer contact portion 12*b* and an inner contact portion 12*c*. Each of the socket contacts 12 has a well-known structure as shown in FIGS. 3A and 3B. The configurations of the socket 2 other than the socket-side lock clasps 10 are well-known in the art and, therefore, will be omitted from description.

Figure 4A:
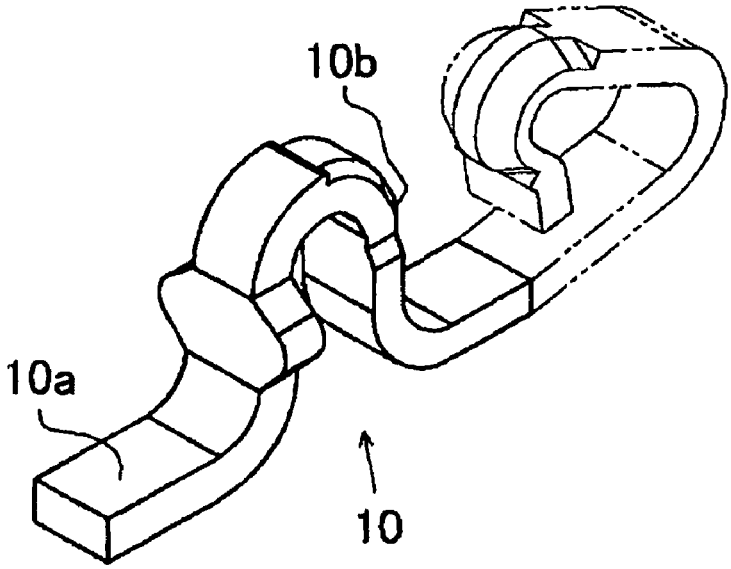
FIG. 4A is a perspective view showing a socket-side lock clasp in accordance with the embodiment of the present invention.
Figure 4B:
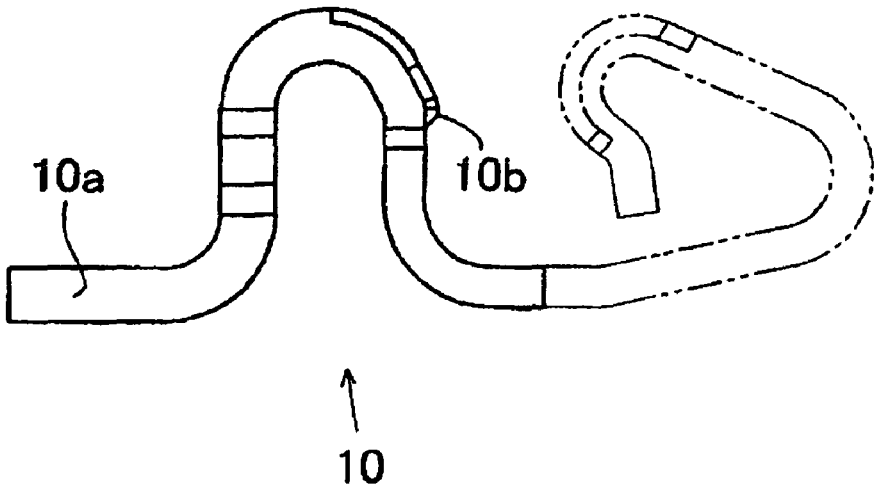
FIG. 4B is a side view thereof.

Referring to FIGS. 4A and 4B, each of the socket-side lock clasps 10 is formed by cutting away a portion (indicated by double-dot chain lines) of each of the socket contacts 12. Each of the socket-side lock clasps 10 has increased elasticity. This makes it possible to form an easy-to-assemble lock mechanism. Each of the socket-side lock clasps 10 includes a retainer portion 10*a* and a lock portion 10*b*.

As shown in FIGS. 1 and 2, the socket-side lock clasps 10 are arranged substantially in the same row as that of the socket contacts 12. Thus, the socket 2 has a simple structure as compared with the complex structure of the conventional socket. This helps increase the productivity of the connector. The socket-side lock clasps 10 are arranged near the four corners at the opposite long sides of the socket body 5. Since the socket 2 and the header 3 are locked to each other near the four corners, it is possible to provide lock mechanisms which are stable and easy-to-assemble as compared with the conventional lock mechanisms arranged in an opposing relationship at the sides where no socket contact exists.

The socket-side lock clasps 10 are insert-molded with the socket body 5. This eliminates the need to employ a step of press-fitting lock mechanisms, which has been conventionally performed after production of the connector. Therefore, there occurs no variation in the planarity of the socket contacts, which has been problematic in the step of press-fitting lock mechanisms.

Figure 5A:
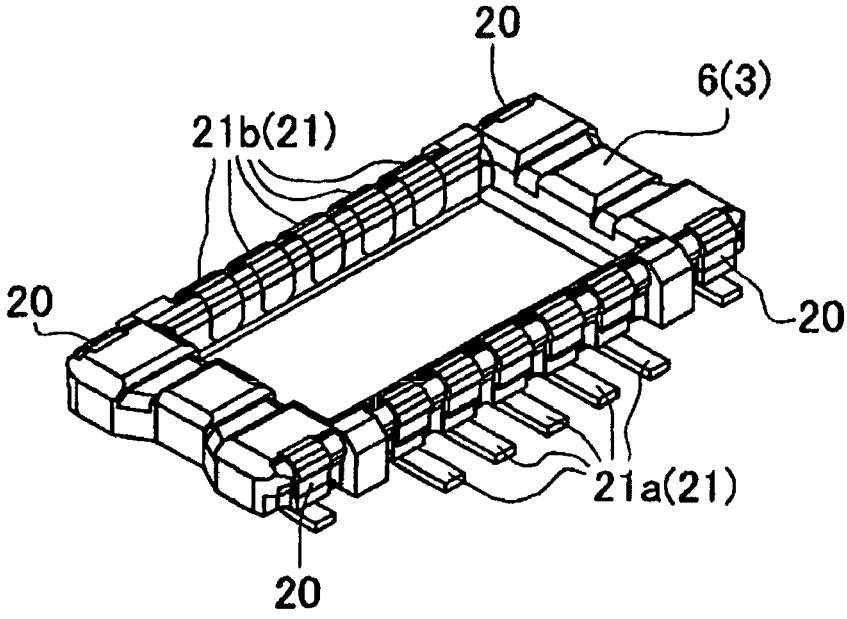
FIGS. 5A and 5B are perspective views showing the header in accordance with the embodiment of the present invention.
Figure 5B:
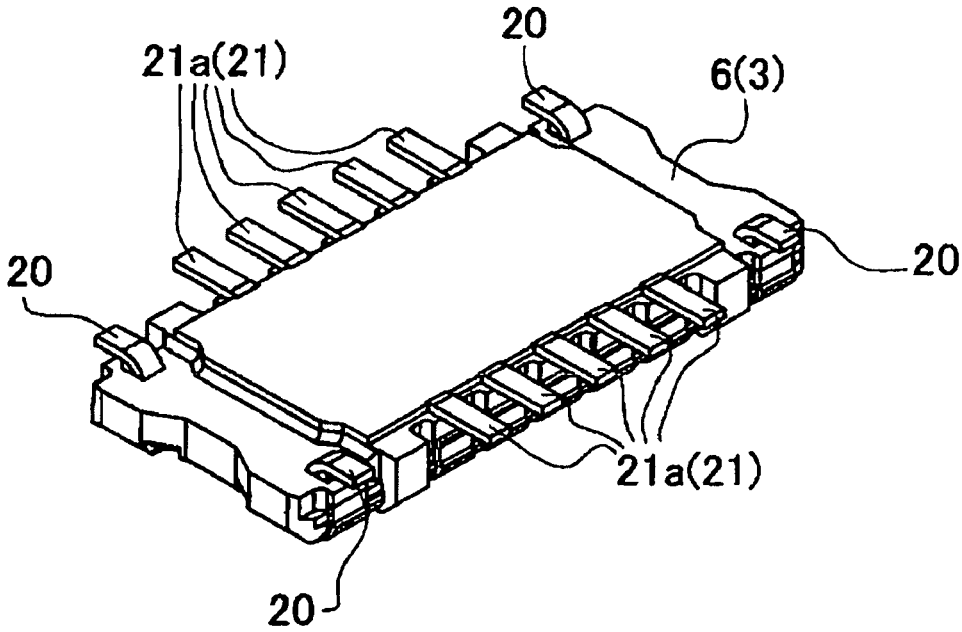
Figure 6A:
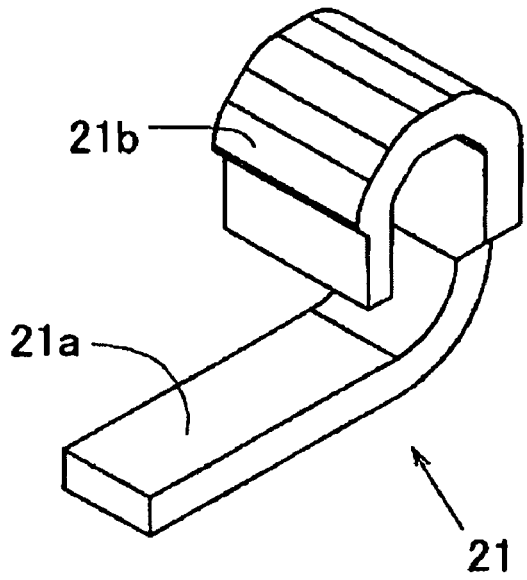
FIG. 6A is a perspective view showing a header contact in accordance with the embodiment of the present invention.
Figure 6B:
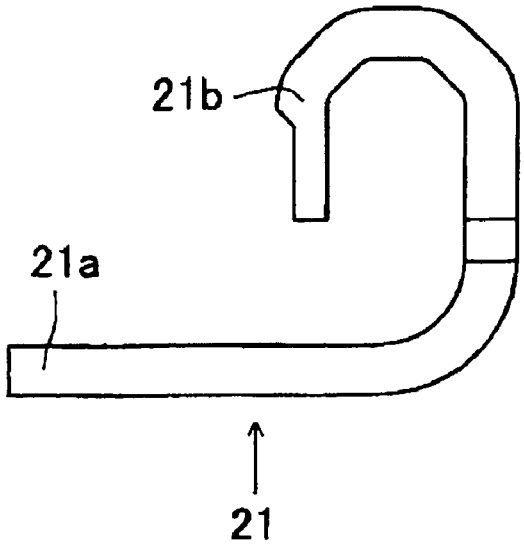
FIG. 6B is a side view thereof.

Next, description will be made on the header 3. FIG. 5A shows the front side of the header 3, and FIG. 5B shows the rear side thereof. The header 3 includes a header body 6, header-side lock clasps (lock mechanisms) 20, and header contacts 21. As shown in FIGS. 6A and 6B, each of the header contacts 21 is formed of a lead pin 21*a* and a contact portion 21*b*. Each of the header contacts 21 has a well-known structure as shown in FIGS. 6A and 6B. The configurations of the header 3 other than the header-side lock clasps 20 are well-known in the art and, therefore, will be omitted from description.

Figure 7A:
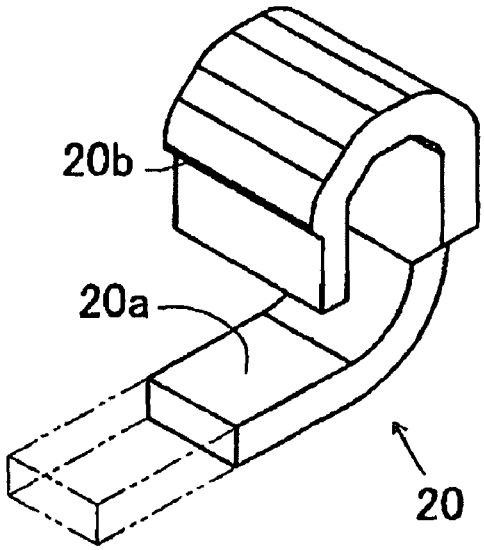
FIG. 7A is a perspective view showing a header-side lock clasp in accordance with the embodiment of the present invention.
Figure 7B:
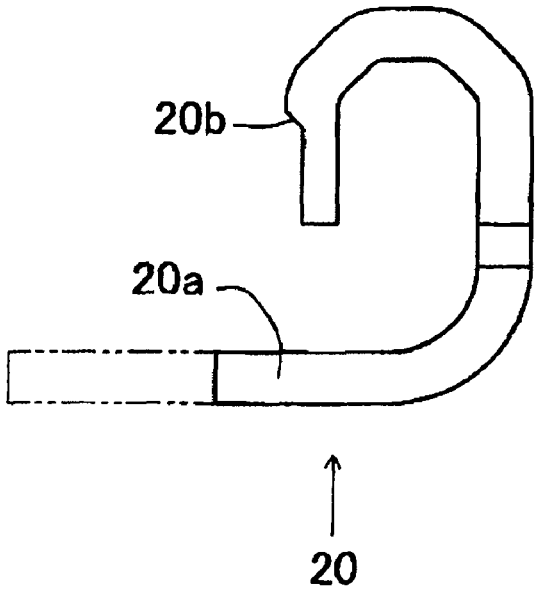
FIG. 7B is a side view thereof.

Referring to FIGS. 7A and 7B, each of the header-side lock clasps 20 is formed by cutting away a portion (indicated by double-dot chain lines) of each of the header contacts 21 so that the lock clasps 20 have a different shape than the header contacts 21. Each of the header-side lock clasps 20 includes a retainer portion (retainer mechanism) 20*a* and a lock portion 20*b*. The retainer portion 20*a* forms the retainer mechanism of the header 3. This means that the header-side lock clasps 20 are configured to serve as both the lock mechanism and the retainer mechanism. Therefore, it is possible to omit the component part that serves as the retainer mechanism in the prior art.

The header-side lock clasps 20 are arranged substantially in the same row as that of the header contacts 21. Thus, the header 3 has a simple structure as compared with the complex structure of the conventional header. This helps increase the productivity of the connector. The header-side lock clasps 20 are arranged near the four corners at the opposite long sides of the header body 6. Since the socket 2 and the header 3 are locked to each other near the four corners, it is possible to provide lock mechanisms which are well-balanced stable as compared with the conventional lock mechanisms arranged at the opposite short sides of the header body.

The header-side lock clasps 20 are insert-molded with the header body 6. This eliminates the need to employ a step of press-fitting lock mechanisms, which has been conventionally performed after production of the connector. Therefore, there occurs no variation in the planarity of the header contacts, which has been problematic in the step of press-fitting lock mechanisms.

Figure 8A:
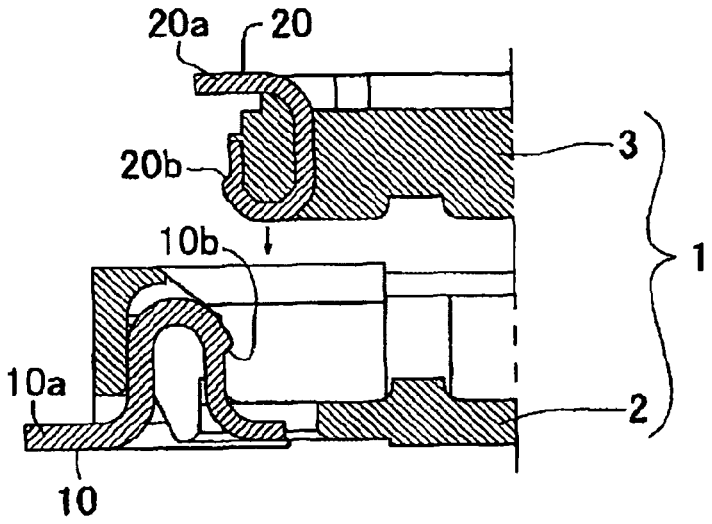
FIGS. 8A through 8C are section views illustrating the operation of lock mechanisms in accordance with the embodiment of the present invention, the lock mechanisms being used to keep the socket and the header in a coupled state.

Subsequently, the operation of the lock mechanisms for keeping the socket 2 and the header 3 in a coupled state will be described with reference to FIGS. 8A through 8C. FIG. 8A illustrates the pre-coupling state of the socket 2 and the header 3.

Figure 8B:
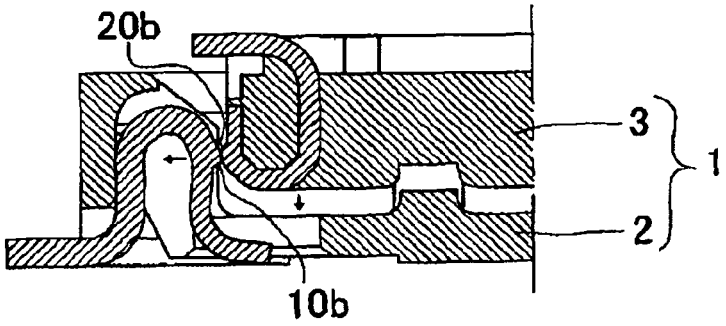

FIG. 8B illustrates a state in which the lock portion 20*b* of the header 3 goes over the lock portion 10*b* of the socket 2. Since the socket-side lock clasps 10 have increased elasticity, the lock portion 10*b* of the socket 2 is bent when it is pressed by the lock portion 20*b* of the header 3. This makes it possible to fit the header 3 to the socket 2 with ease.

Figure 8C:
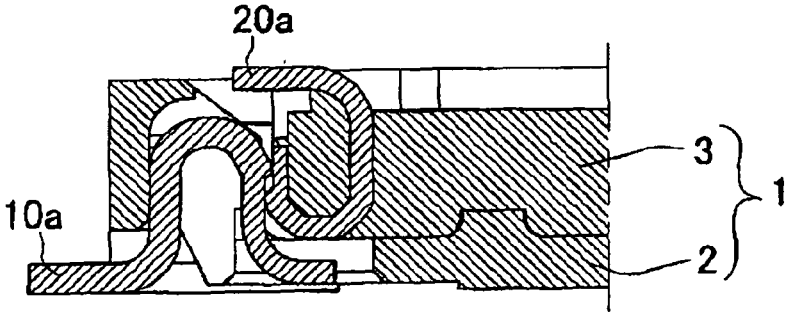

FIG. 8C illustrates a state in which the socket-side lock clasps 10 and the header-side lock clasps 20 are coupled together. The header-side lock clasps 20 are held in place under the pressing force of the socket-side lock clasps 10. The holding force acting at this time is equal to the coupling force of the socket-side lock clasps 10 and the header-side lock clasps 20 and is added to the coupling force of the socket contacts 12 and the header contacts 21, thus resulting in an increased coupling force. This provides a configuration in which the socket 2 and the header 3 are hard to be separated from each other.

Figure 9:
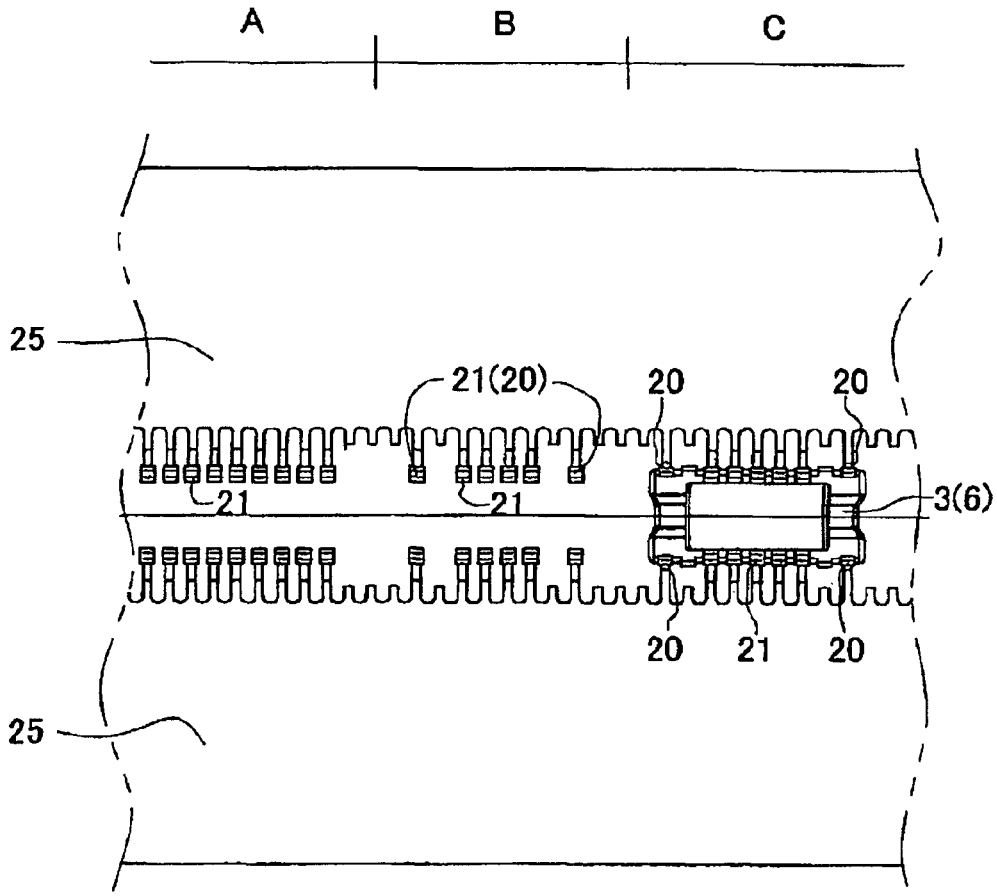
FIG. 9 is a plan view illustrating the header under a manufacturing process in accordance with the embodiment of the present invention.
Figure 10:
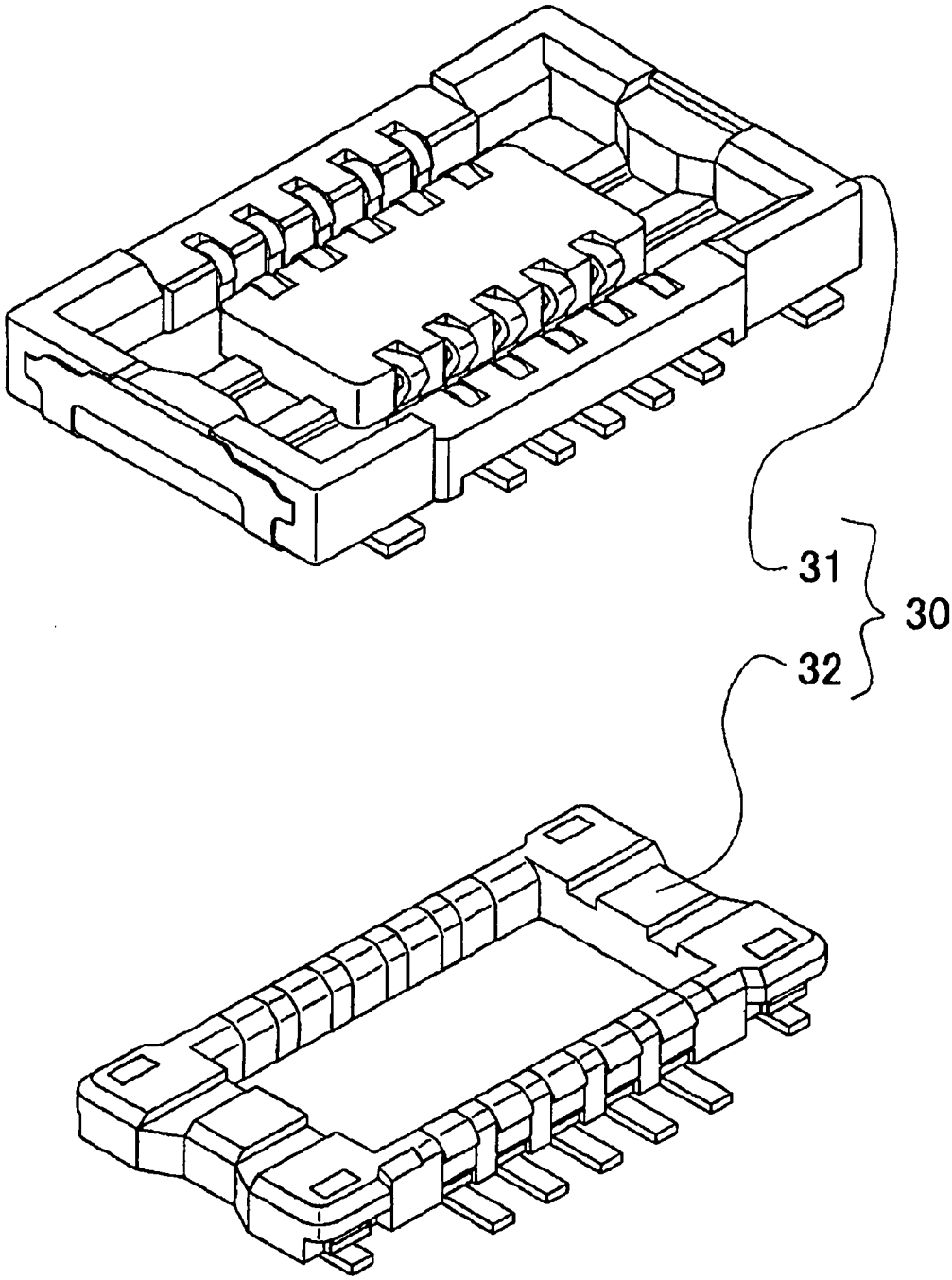
FIG. 10 (PRIOR ART)
FIG. 10 is a perspective view showing a conventional connector provided with a socket and a header.
Figure 11:
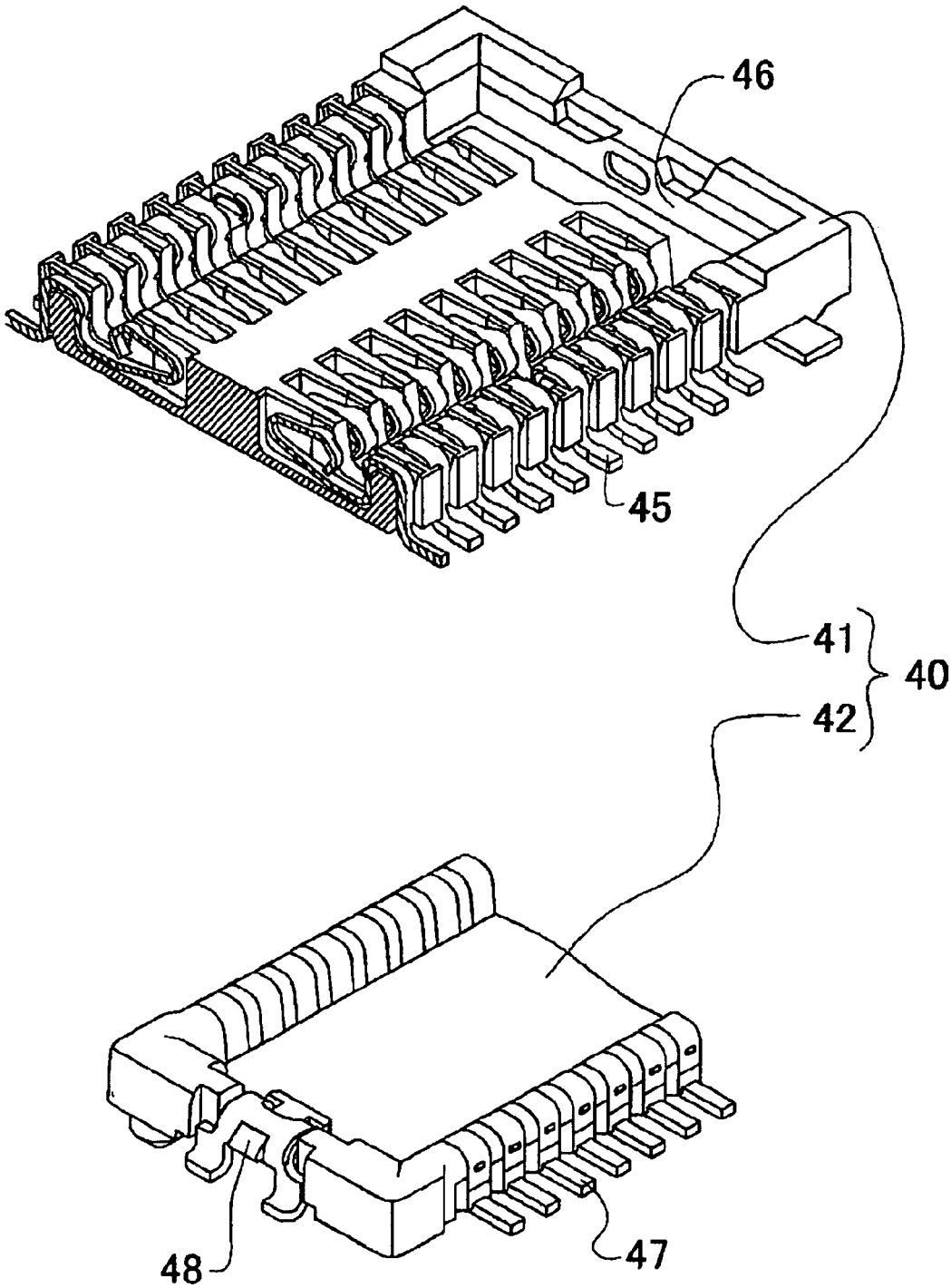
FIG. 11 (PRIOR ART)
FIG. 11 is a partially cutaway perspective view showing a conventional connector provided with a lock mechanism.

Next, a method for manufacturing the connector provided with the lock mechanisms for keeping the socket and the header in a coupled state will be described in detail with reference to the header 3 shown in FIGS. 5A and 5B. Referring to FIG. 9, the manufacturing process of the header 3 is divided into stations A through C arranged sequentially.

In station A, header contact workpieces 25 have an elongated shape and are provided with a plurality of header contacts 21 as a part thereof. In station B, unnecessary header contacts 21 are cut away, leaving only the header contacts 21 that will form the header 3. The header contacts 21 left at the opposite ends are used as the header-side lock clasps 20. In station C, the header contacts 21 left in station B are insert-molded with the header body 6 to form the header 3.

Figure 12:
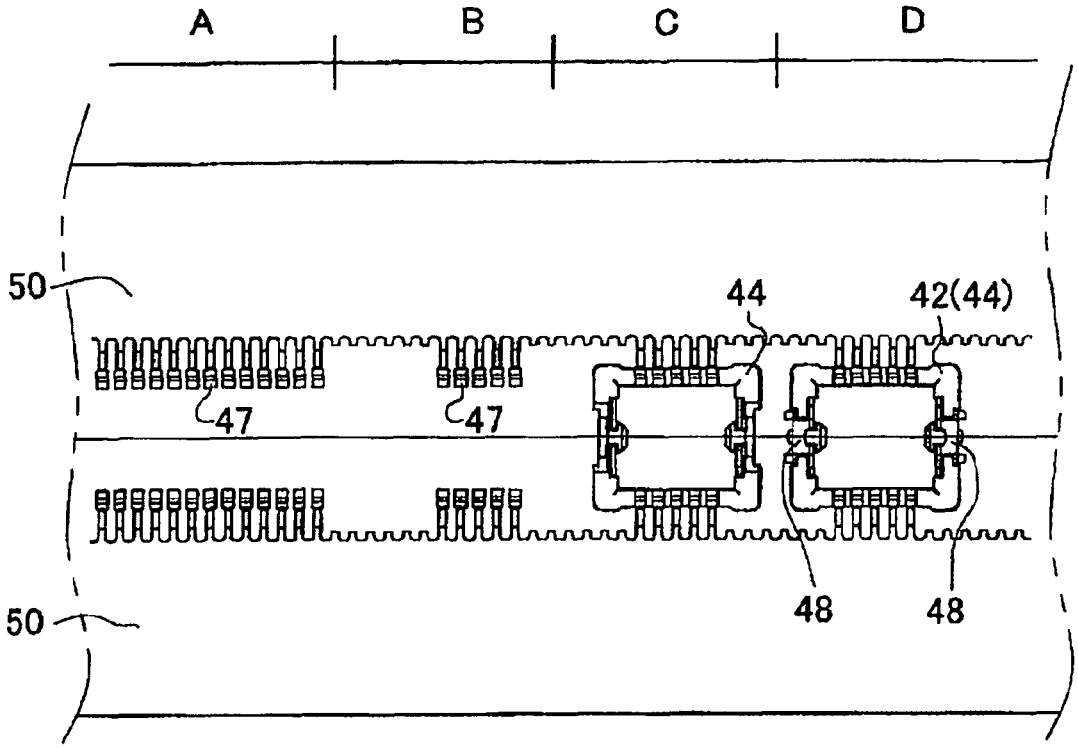
FIG. 12 (PRIOR ART)
FIG. 12 is a plan view illustrating the conventional header provided with the lock mechanism, which is under a manufacturing process.

The present manufacturing method omits the step of press-fitting lock mechanisms (station D in FIG. 12), which has been performed in the prior art. Therefore, there occurs no variation in the planarity of the header contacts, which has been problematic in the step of press-fitting lock mechanisms. Omission of the step of press-fitting lock mechanisms helps simplify the manufacturing process of the connector 1. Accordingly, it is possible to enhance the assembling accuracy and product precision of the connector 1.

While the invention has been shown and described with respect to the embodiments, it will be understood by those skilled in the art that various changes and modifications may be made without departing from the scope of the invention as defined in the following claims.

What is claimed is:

1. A connector comprising:

a socket having a generally rectangular shape, the socket including socket contacts, lock mechanisms and retainer mechanisms; and a header having a generally rectangular shape, the header including header contacts and lock mechanisms and being couplable with the socket, wherein the lock mechanisms of the socket and the header are respectively formed from the socket contacts and the header contacts, the lock mechanisms of the socket being formed by cutting away a portion of the socket contacts, the lock mechanisms of the header also serving as retainer mechanisms thereof, the lock mechanisms of the socket being arranged substantially in the same row as the socket contacts and positioned near four corners of the socket, the lock mechanisms of the header being arranged substantially in the same row as the header contacts and positioned near four corners of the header, the lock mechanisms of the socket and the header being configured to keep the socket and the header in a coupled state.

2. The connector of claim 1, wherein the lock mechanisms of the socket and the header are insert-molded in the socket and the header, respectively.

3. A method for manufacturing a connector, comprising the steps:

providing a socket contact workpiece having a plurality of socket contacts;

cutting away a portion of each of socket contacts selected from the plurality of socket contacts to form socket lock clasps from the selected socket contacts;

forming a socket having a generally rectangular shape and provided with the socket lock clasps and the remaining socket contacts other than the selected socket contacts;

providing a header contact workpiece having a plurality of header contacts;

cutting away a portion of each of header contacts selected from the plurality of header contacts to form header lock clasps from the selected header contacts; and forming a header having a generally rectangular shape and provided with the lock clasps and the remaining header contacts other than the selected header contacts, wherein the socket and the header lock clasps are configured to keep the socket and the header in a coupled state.

4. The method of claim 3, wherein the socket lock clasps are arranged on opposite long sides of the socket and the header lock clasps are arranged on opposite long sides of the header.

5. The method of claim 3, wherein the socket lock clasps are positioned near four corners of the socket and the header lock clasps are positioned near four corners of the header.

6. The method of claim 3, wherein said forming the socket and the header are performed by insert molding.

7. A method for manufacturing a socket for a connector, comprising the steps:

providing a socket contact workpiece having a plurality of socket contacts;

cutting away a portion of each of socket contacts selected from the plurality of socket contacts to form socket lock clasps from the selected socket contacts; and forming the socket provided with the socket lock clasps and the remaining socket contacts other than the selected socket contacts, wherein the socket lock clasps are configured to keep the socket and a header of the connector in a coupled state.

8. The method of claim 7, wherein the socket lock clasps are arranged on opposite long sides of the socket.

9. The method of claim 7, wherein the socket lock clasps are positioned near four corners of the socket.

10. The method of claim 7, wherein said forming the socket is performed by insert molding.

11. A method for manufacturing a header for a connector, comprising the steps:

providing a header contact workpiece having a plurality of header contacts;

cutting away a portion of each of header contacts selected from the plurality of header contacts to form header lock clasps from the selected header contacts; and forming the header provided with the header lock clasps and the remaining header contacts other than the selected header contacts, wherein the header lock clasps are configured to keep the header and a socket of the connector in a coupled state, and wherein the lock clasps have a different shape than the plurality of header contacts.

12. The method of claim 11, wherein the header lock clasps are arranged on opposite long sides of the header.

13. The method of claim 11, wherein the header lock clasps are positioned near four corners of the header.

14. The method of claim 11, wherein said forming the header is performed by insert molding.

15. A socket for a connector, comprising:

a plurality of socket contacts; and lock clasps, wherein the socket has a generally rectangular shape, and wherein the lock clasps of the socket are formed from other socket contacts than the plurality of socket contacts by cutting away a portion of each of the other socket contacts, the lock clasps of the socket being configured to keep the socket and a header of the connector in a coupled state.

16. The socket for a connector of claim 15, wherein the lock clasps of the socket are insert-molded in the socket.

17. The socket for a connector of claim 15, wherein the lock clasps of the socket are positioned near four corners of the socket.

18. A header for a connector, comprising:

a plurality of header contacts; and lock clasps, wherein the header has a generally rectangular shape, wherein the lock clasps of the header are formed from other header contacts than the plurality of header contacts by cutting away a portion of each of the other header contacts, the lock clasps of the header being positioned near four corners of the header, the lock clasps of the header being configured to keep the header and a socket of the connector in a coupled state, and wherein the lock clasps have a different shape than the plurality of header contacts.

19. The the header for a connector of claim 18, wherein the lock clasps of the header are insert-molded in the header.

20. The the header for a connector of claim 18, wherein the lock clasps of the header are positioned near four corners of the header.

* * * * *